US005850587A

United States Patent [19]

Schmidlin

[11] Patent Number: 5,850,587

[45] Date of Patent: Dec. 15, 1998

[54] ELECTROSTATIC TONER CONDITIONING AND CONTROLLING MEANS II

[76] Inventor: Fred W. Schmidlin, 8 Forestwood La., Pittsford, N.Y. 14534

[21] Appl. No.: 53,222

[22] Filed: Apr. 1, 1998

[51] Int. Cl.[6] ..... G03G 15/08

[52] U.S. Cl. ..... 399/258; 118/625; 347/158; 361/233

[58] Field of Search ..... 399/258, 261; 118/621, 625; 347/112, 158; 361/233

[56] References Cited

U.S. PATENT DOCUMENTS

| | | | |
|---|---|---|---|
| 3,872,361 | 3/1975 | Masuda | 361/233 |
| 4,568,955 | 2/1986 | Hosoya et al. | 347/158 X |
| 4,647,179 | 3/1987 | Schmidlin | 399/285 |
| 4,743,926 | 5/1988 | Schmidlin et al. | 347/55 |

*Primary Examiner*—Richard Moses
*Attorney, Agent, or Firm*—Robert J. Bird

[57] ABSTRACT

A system for delivering electrostatic toner to an image receiving member includes a traveling electrostatic wave toner conveyor with a delivery segment adjacent to the image receiving member. The delivery segment includes parallel traveling wave conveyor electrodes and nudging electrodes. The conveyor electrodes are connected to a source of DC-biased multiphase electric power to establish a traveling electrostatic wave in the delivery segment to move toner in a synchronous surfing mode. The nudging electrodes are connected to a source of repulsive DC voltage of the same polarity as the toner to slow and deflect toner toward the image receiving member. The delivery segment further includes overlaid barrier electrodes to maintain uniform delivery of toner to all apertures in an electronically addressable printhead.

19 Claims, 4 Drawing Sheets

ELECTROSTATIC TONER CONDITIONING AND CONTROLLING MEANS II

BACKGROUND OF THE INVENTION

This invention relates to electrostatic printing devices and more particularly to a toner delivery system for presenting toner to a charge retentive surface or to an electronically addressable printhead utilized for depositing toner in image configuration on plain paper substrates.

This invention is an extension of the invention disclosed in my U.S. Pat. No. 5,541,716, issued Jul. 30, 1996 (hereinafter the "716 patent"). This invention includes alternative means of operating the delivery segment in the 716 patent to achieve operable conditions of toner delivery for applications that can not be satisfied by the means described in this former patent. This patent also describes the delivery of toner via parallel transport paths to facilitate development at high process speeds.

The "hunching" mode of toner transport described in the 716 patent cannot be utilized in all applications of interest, especially at higher process speeds, exceeding say 0.3 m/sec. I have also learned through recent experimentation that the hunching mode described in the 716 patent may not be operable with triboelectrified toner.

Therefore, one objective of the present invention is to provide alternative versions of segmented traveling wave conveyors which are operable with a wider variety of materials, including triboelectrified toner, and a wider range of process speeds. Another objective of the present invention is to provide means of providing toner mass flow rates consistent with the process speed required for a particular application.

Still another objective of the present invention is to provide means of maintaining uniform delivery of toner to an image receiving member.

The invention described herein is applicable to all imaging systems that require development of an electrostatic latent image, including xerographic copiers and printers, ionographic printers, and direct powder projection printers.

SUMMARY OF THE INVENTION

This invention is a system for delivering electrostatic toner to an image receiving member. It includes a traveling electrostatic wave toner conveyor with a delivery segment adjacent to the image receiving member, the delivery segment including parallel traveling wave conveyor electrodes and nudging electrodes. The conveyor electrodes are connected to a source of DC-biased multiphase electric power to establish a traveling electrostatic wave in the delivery segment to move toner in a synchronous surfing mode. The nudging electrodes are connected to a source of repulsive DC voltage of the same polarity as said toner to further urge toner toward the image receiving member.

DRAWINGS

Figure 2:
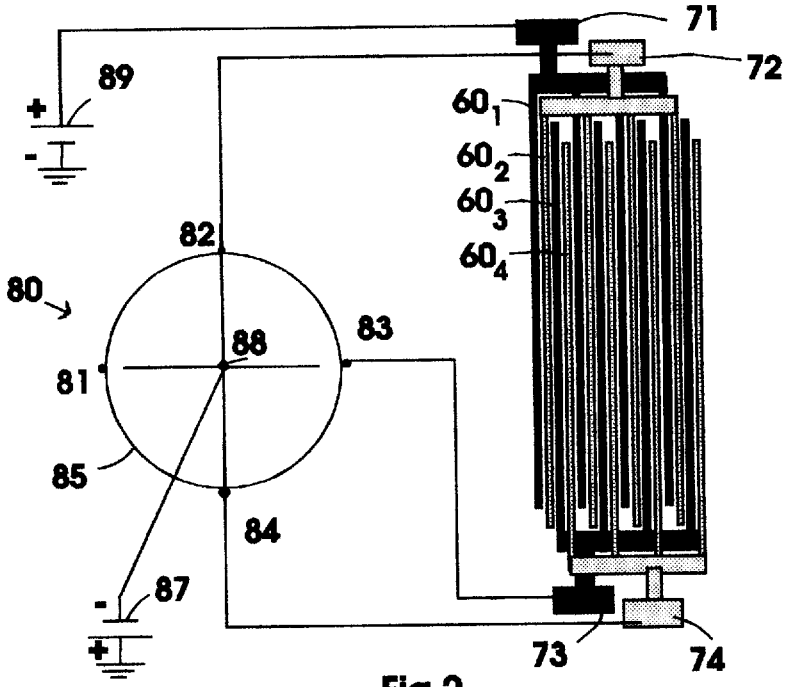
FIG. 2 is a schematic plan view of the delivery segment configured in accordance with the present invention.
Figures 5A, 5B:
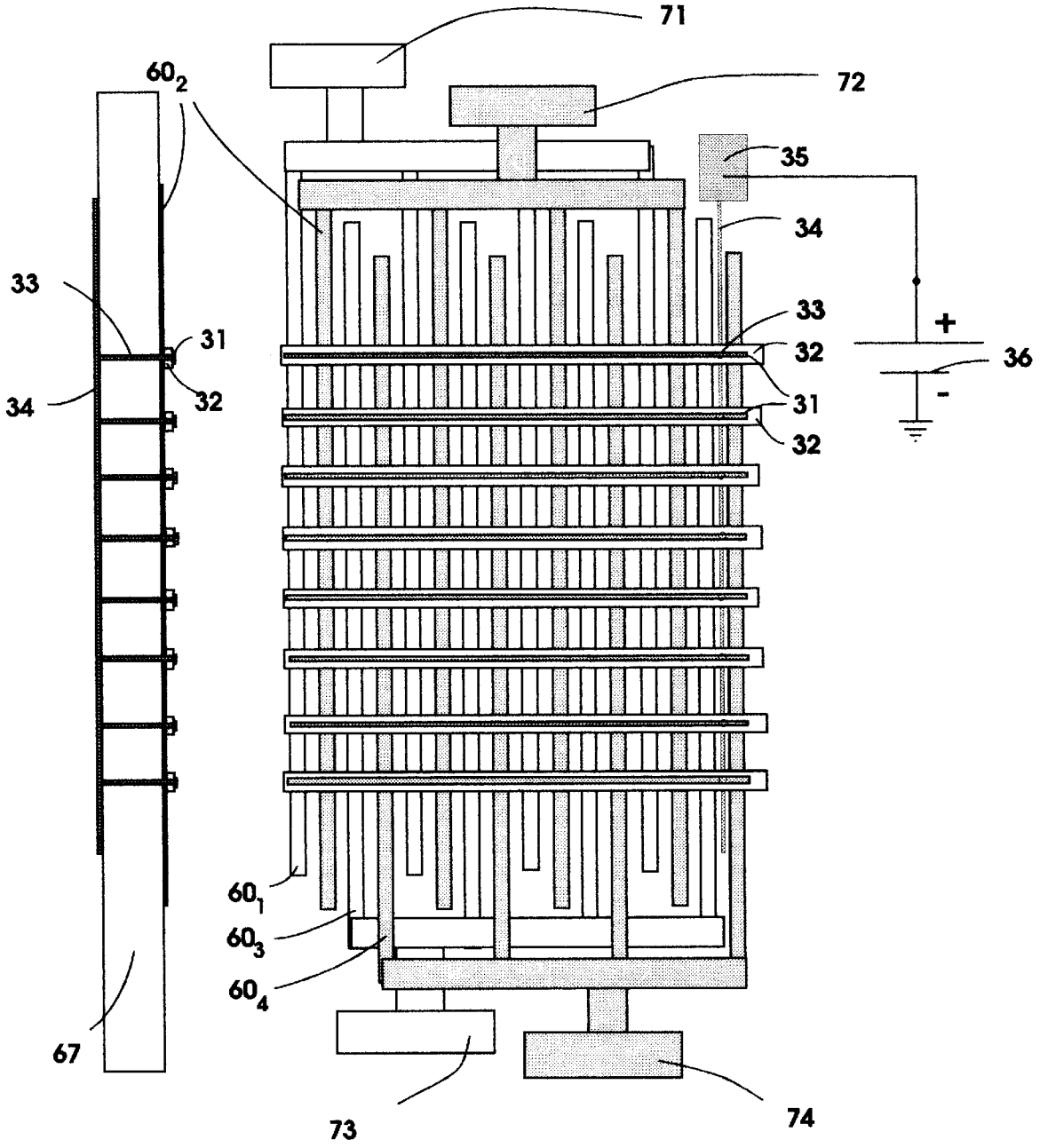

FIG. 5*a* is a schematic plan view of the delivery segment in FIG. 2, including superposed barrier electrodes that subdivide the toner conveyor into pixel wide columnar conveyors.

FIG. 5*b* is a schematic edge view of the delivery segment in FIG. 5*a*.

DETAILED DESCRIPTION OF THE INVENTION

The disclosure of my above-mentioned U.S. Pat. No. 5,541,716 is hereby incorporated in this specification by reference.

Figure 1:
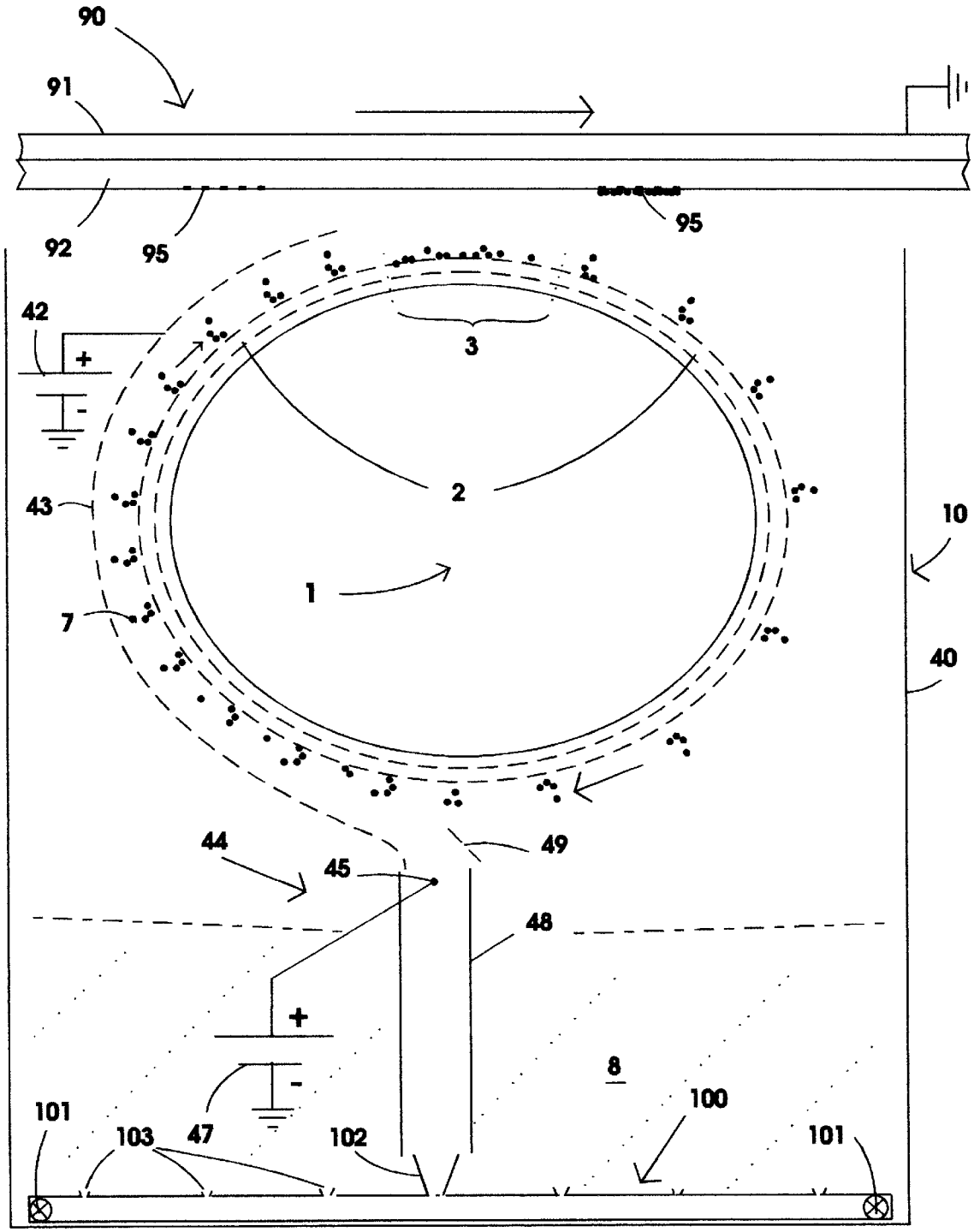
FIG. 1 is a schematic elevation view of a segmented traveling wave toner conveyor for delivering toner to a latent image bearing member.

FIG. 1 is a schematic elevation view of a segmented traveling wave toner conveyor as described in the referenced 716 patent. The apparatus includes a traveling wave toner delivery system 10 and an image receiver 90.

The toner delivery system 10 includes a segmented traveling wave conveyor 1 housed in an enclosure 40 which also includes a toner sump 8. The segmented conveyor 1 is stationary, and includes separately operable segments: a loading/filtering (LF) segment 2, and a delivery (D) segment 3.

The image receiver 90 shown in the example is a xerographic surface which includes a dielectric (or photoconductive) layer 92 over a conductive backing 91. An electrostatic latent image 95 formed on the layer 92 is carried past the toner delivery system 10 where toner is deposited on the latent image.

FIG. 2 is a schematic plan view of the delivery segment 3 of the traveling wave conveyor 1. The four-phase delivery segment 3 includes connection pads 71, 72, 73, 74, each of which is respectively connected to a number of parallel conveyor electrodes $\mathbf{60}_1$, $\mathbf{60}_2$, $\mathbf{60}_3$, $\mathbf{60}_4$ in an interdigitated pattern. A four-phase generator 85 in a power source 80 includes terminals 81, 82, 83, 84 adapted for connection respectively to the connection pads 71, 72, 73, 74 of the delivery segment 3. A source 87 of dc "bias" voltage is connected to the common terminals 88 of the generator 85. The amplitude and frequency of voltages supplied by the generator 85, in combination with the dc bias of source 87, control the movement of toner on the delivery segment 3.

The apparatus described to this point is also described in my 716 patent. This invention is an extension of that earlier invention. It involves modification of the delivery segment to include a "nudging" electrode.

FIG. 2 shows one example of a nudging electrode. In FIG. 2, one phase of the 4-phase delivery segment 3 is simply disconnected from the 4-phase generator 85 and connected to a "repulsive" dc voltage source 89. I have found experimentally that transport of toner on the conveyor segment 3 continues to be supported by the remaining three phases. A repulsive dc voltage (of the same polarity as the toner) applied to the nudging electrodes $\mathbf{60}_1$ (formerly the phase 1 conveyor electyrodes), on the other hand, now serves to deflect or "nudge" the toner into an arcuate path that passes through the latent image residing on the receiver member 90. By careful adjustment of the magnitude of the repulsive voltage on the nudging electrode, toner can be deflected onto the latent image (i.e. into close proximity with the latent image resident on the image receiver member) without forcing the toner onto non-image areas of the image receiver 90. Improved image quality in the developed areas is thus achieved without encountering excessive interaction, or scavenging, of toner previously developed on the image bearing member. Multiple development applications, such as "color-on-color" (as discussed in the 716 patent), are thereby facilitated.

Figure 3:
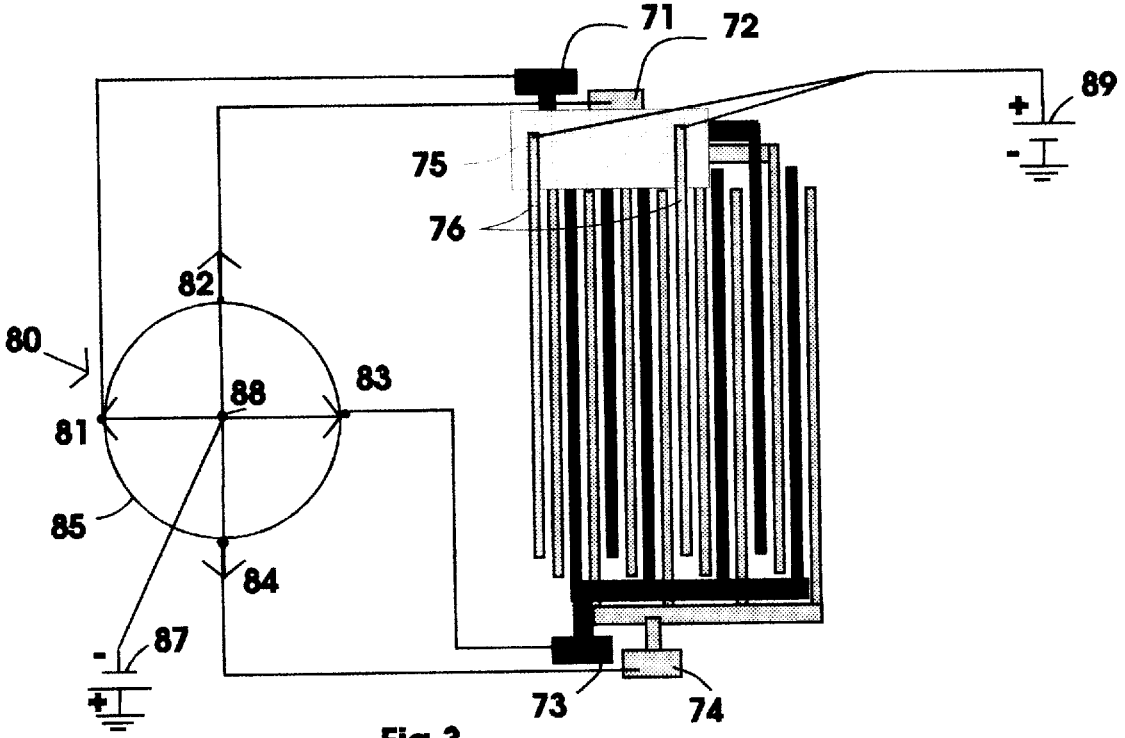
FIG. 3 is a schematic plan view, similar to FIG. 2, and including nudging electrodes in the delivery segment.

An alternative to converting all the electrodes of an entire phase of the 4-phase delivery segment 3 to nudging electrodes, is to isolate individual electrodes of the conveyor 3 and connect them to the dc voltage source 89. FIG. 3 shows two nudging electrodes 76 added to the delivery segment 3, and connected to a source 89 of repulsive dc voltage. A dielectric film 75 is placed between the conveyor electrodes and the nudging electrodes 76 to selectively isolate the nudging electrodes 76 and to facilitate their connection to the dc voltage source 89. Any such arrangement of individual electrodes, either added to the conveyor structure via insertion between conveyor electrodes, or converted from the multiphase conveyor for the purpose of controlling the path of toner near a latent image, is considered part of this invention.

The importance of this nudging electrode is that it facilitates the achievement of good or acceptable image quality with much higher transport speeds of toner on the delivery segment of the conveyor than would otherwise be possible. In particular it enables the use of the surfing mode of transport on the delivery segment of the conveyor which is operational for a wide variety of toner materials, including triboelectrified toner.

Exploratory tests in which one phase of a 4-phase conveyor was converted to a nudging electrode have shown that significant improvement in developed density and image quality can be achieved with a repulsive voltage of 50 volts on the nudging electrode. Toner did not adhere to the conveyor grid as a result of converting a single phase of the conveyor to a dc nudger. In this test the wavelength of the conveyor was 0.5 mm, the wave amplitude was 460 volts and the frequency was 3.0 kHz. The image for this test was stationary and spaced 0.43 mm from the conveyor surface. The image potential was 75 volts with a background bias of 225 volts (300 volts image contrast potential). The conveyor was loaded to 6.4 mg/(cm-sec), well below the maximum achieved with this conveyor.

A general requirement of any developer system is that sufficient toner be delivered a latent image to develop high density areas at the desired process speed. Designating the desired image process speed by $v_i$, and the highest required developed mass per unit area by $(m/a)_i$, the required mass delivery rate by the developer is given by their product $v_i(m/a)_i$. The toner mass flow rate supplied by the developer, designated dm/dt, must exceed $v_i(m/a)_i$.

Toner transport via traveling wave transport can be similarly characterized by the wave speed $v_w$ and average mass per unit area transported by the wave, $(m/a)_w$. Indeed, $(m/a)_w \equiv dm/dt/v_w$ serves to define $(m/a)_w$. Unfortunately, the traveling wave transport data base is still very limited, but the highest dm/dt achieved to date is of the order of 25 mg/(cm/sec) at a wave speed of $v_w$=1.5 m/sec. Thus a representative value for $(m/a)_w$ is approximately ⅙ mg/cm$^2$. This is a key quantity characterizing wave limited transport, for it remains approximately constant at different wave speeds.

Given the limited magnitude of $(m/a)_w$, an essential requirement for the choice of the wave speed for traveling wave development (utilizing a single conveyor path) is $v_w \geqq v_i(m/a)_i/(m/a)_w$. Assuming $(m/a)_i \cong 1$ mg/cm$^2$, a representative requirement of practical powder development systems, the above limitation on $(m/a)_w$ leads to $v_w \geqq 6v_i$. This is a very high toner speed in relation to the image speed, which may preclude the achievement of acceptable image quality without the use of the nudging electrode.

Figure 4:
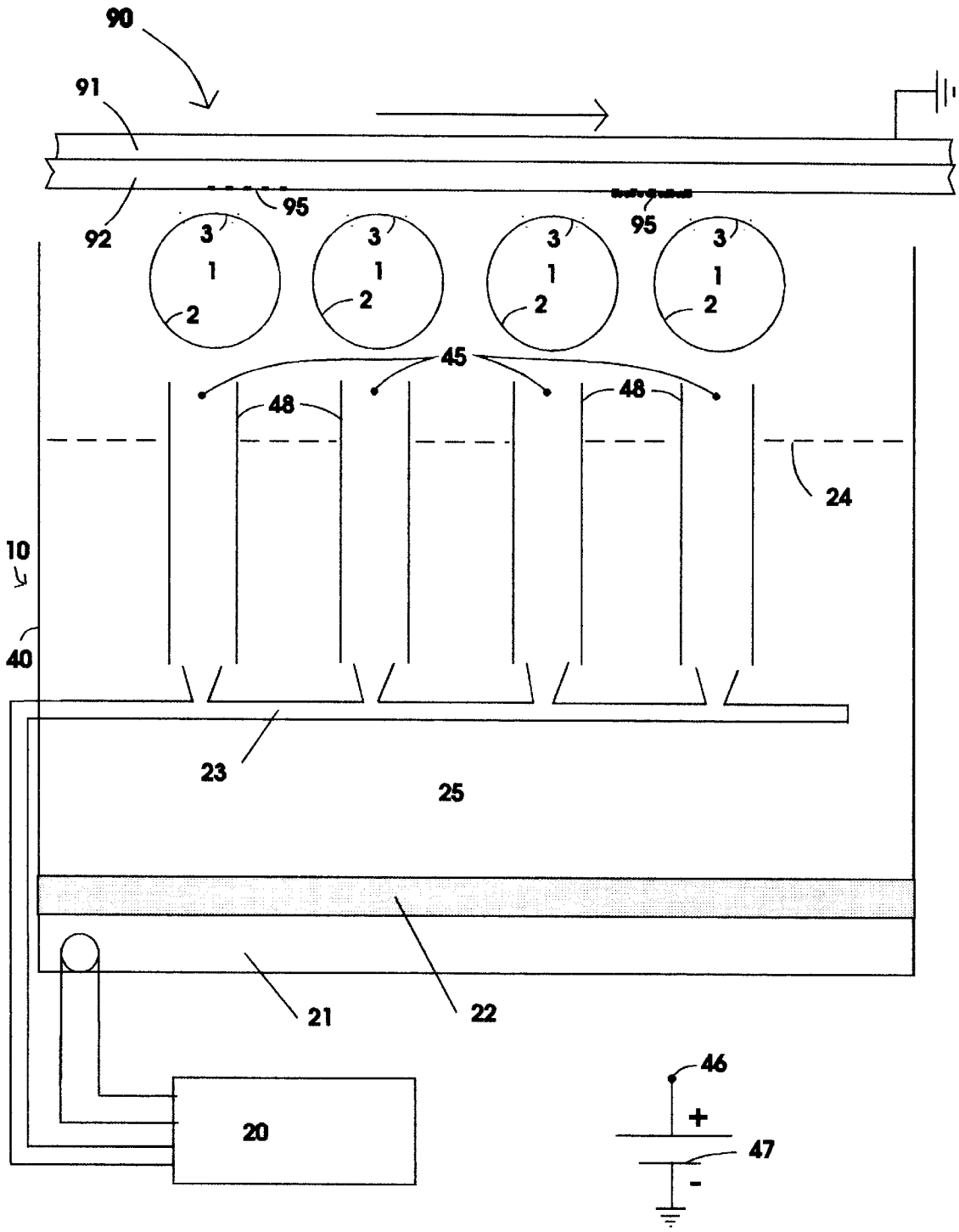
FIG. 4 is a schematic elevation view of a traveling wave development system with parallel conveyor paths disposed between a fluidized bed toner supply and an image receiver member.

Multiple conveyor paths between toner supply and image receiver can be used to greatly expand the applicability of traveling cloud development. FIG. 4 shows a traveling wave development system with a number N of parallel conveyors 1 between a fluidized toner supply or bed 25 and an image receiver member 90. The several conveyors 1 are individually loaded with toner via corona currents from corona wires 45. The latter are collectively, or individually, connected to terminal 46 of a current controlled voltage supply 47. The depth of submersion of the corona wires 45 in the fluidized toner is controlled by positioning the wires 45 a desired distance from the top of the flow channels 48 and maintaining these channels in an overflowing condition by means of air jetted from an air distribution system 23. This system continuously pumps fluidized toner from the toner bed 25. The toner bed 25 is maintained at a level 24 between the top and bottom of the flow channels 48 by means of a suitable toner refilling device, not shown. A controlled flow compressed air system 20 continuously supplies air to the air distribution system 23 and to an air plenum 21 below a porous membrane 22 which supports the toner bed 25.

The multiple path transport system described above includes a corona charging/loading device, but any single component or dual component charging/developing device known in the art of will serve to load the traveling waves as well, and is within the spirit of this invention.

With $N_p$ parallel conveyor paths, the burden on the mass flow per path is reduced by the same factor. The required minimum wave velocity is similarly reduced to $v_w \geqq v_i(m/a)_i/(m/a)_w/N_p$, or $6v_i/N_p$, for the aforementioned example. This facilitates accommodation of higher image speeds as well as a lower $v_w/v_i$ speed ratio. The optimal number of parallel conveyor channels is one less than $(m/a)_i/(m/a)_w$, or 5 in the foregoing example. This will reduce the speed difference, $v_w - v_i$, to within 10 to 20% of $v_i$, which is the optimal range for the best quality image development.

Image processing speeds between 1 and 2 m/sec can be readily accommodated with presently existing toner conveyors of 0.5 mm wavelength. Higher and lower speed ranges can be most easily accommodated via conveyors of longer of shorter wavelength. With $N_p$=2, 3, or 4, image speeds up to 0.5, 0.75, or 1 m/sec respectively may be accommodated with a 0.5 mm wavelength conveyor. Higher speed ratios $(v_w/v_i)$ will accompany these designs which will benefit from use of a nudging electrode.

Traveling wave development technology is well suited to high speed imaging applications, especially duplicators in the 100 to 500 pages per minute range. Lower speed applications can also be accommodated by use of delivery segments with the shortest wave length manufacturable, say 0.1 to 0.2 mm. To accommodate a transfer from a long wavelength loading conveyor to a shorter wavelength delivery conveyor the wavelength change can be made gradual in the transitional range. That is: the wave length can be reduced by a small percentage, say 10 to 15% per wavelength, until the total desired change is achieved. For example, a factor of two reduction in wavelength can be achieved in five waves with a 15% reduction in length of each successive wave. This will allow toner to gradually reduce their speed as the wave speed reduces while staying in approximately the correct phase relationship with the traveling wave.

This invention further includes a traveling wave toner delivery system wherein the delivery segment 3 is overlaid with "barrier electrodes" to create narrow parallel channels of toner flow, wherein the width of the channels is made comparable in size to the apertures in an electronically addressable printhead. When toner is removed from the conveyor by one aperture the toner on the remainder of the conveyor will continue to move undisturbed. Without the barrier electrodes the toner on the conveyor would redistribute, moving into the emptied spaces. This would change the available toner density available to subsequent apertures and thereby cause an unwanted history effect. The concept of barrier electrodes has been used to avoid lateral dispersion of toner in image configuration on a digital packet conveyor by Peter Salmon in conjunction with his digital packet printer described in U.S. Pat. Nos. 5,153,617, 5,287,127, and 5,400,062. However, the idea of using the barrier electrodes as a preventive measure to assure uniformity of toner delivery to an addressable printhead is a new and novel use of the barrier electrodes not previously appreciated. Indeed, it will now be realized that the barrier electrodes will serve to improve the uniformity of toner delivery during transfer from a supply conveyor to an image receiver when such transfer occurs over extended distances, as generally occurs in imaging devices such as the apertured type of printheads used for Direct Electrostatic Printing (DEP), or Array Printers TonerJet®. See U.S. Pat. Nos. 4,860,036 and 4,814,796 for DEP reference or Jerome Johnson, "An Etched Circuit Aperture Array for TonerJet® printing", IS&T's Tenth Int. Cong. on Advances in Non-Impact Printing Technologies (1994), p. 311 for TonerJet® reference. In such devices toner is delivered to four or more successive rows of apertures, each displaced downstream (in the direction of toner flow) from the last row by five or more pixel diameters (typically 0.4 mm or more between rows). Whence toner removed from the conveyor for the first row of apertures will have time to redistribute on a wave front (via self electrostatic repulsion) and weaken the amount of toner available for the subsequent rows. This will degrade the quality of the image printed. Such image degradation is now avoidable via the incorporation of barrier electrodes in the supply conveyor, and especially in the delivery segment 3 of a toner delivery system. Concern over the effects of toner redistribution on a toner supply conveyor has been a deterrent to the application of traveling wave toner delivery for direct powder printing applications. This deterrent is now eliminated via this invention.

FIGS. 5*a* and 5*b* are schematic plan and edge views respectively of a toner delivery segment 3 including barrier electrodes in accordance with the present invention. The barrier electrodes 31 are overlaid above the conveyor electrodes and electrically insulated therefrom via insulating bars 32. The barrier electrodes 31 are connected to the common bus electrode 34 via small interconnection electrodes 33 passing through the conveyor substrate 67. A dc bias voltage 36 of the same polarity as the toner (assumed positive for this drawing) is applied to terminal 35 which is electrically connected to the barrier electrodes 31. The barrier electrodes 31 are spaced and positioned so that each column conveyor (bounded by neighboring barrier electrodes) delivers toner to one aperture in an apertured printhead.

What is claimed is:

1. A system for delivering electrostatic toner to an image receiving member, including:

a traveling electrostatic wave toner conveyor including a toner loading segment and a toner delivery segment;

said toner delivery segment adapted to receive toner from said loading segment and to present said toner for deposition on said image receiving member;

said delivery segment including parallel conveyor electrodes and nudging electrodes;

said conveyor electrodes operatively connected to a "multiphase" source of DC-biased multiphase electric power to establish a traveling electrostatic wave in said delivery segment to move toner in a synchronous surfing mode;

said nudging electrodes operatively connected to a "repulsive" source of repulsive DC voltage of the same polarity as said toner to defect the path of said toner toward said image receiving member.

2. A system as defined in claim 1, wherein said multiphase power is 4-phase power and said delivery segment includes four delivery phases, three of said delivery phases being operatively connected to said multiphase source, and one of said delivery phases being operatively connected to said repulsive source.

3. A system as defined in claim 1, wherein said nudging electrodes are inserted between said conveyor electrodes in said delivery segment.

4. A system as defined in claim 1, wherein the traveling wave in said toner conveyor is of shorter wavelength in said delivery segment than in said loading segment, and the transition between wavelengths on said loading and delivery segments is a stepwise transition over a plurality of waves to maintain said surfing mode of toner motion thereon.

5. A system as defined in claim 1, wherein the speed of toner movement to said image receiving member is subject to control by choice of wavelength and frequency of said multiphase power on said delivery segment.

6. A system as defined in claim 1, wherein the wavelength of said delivery segment is between 0.1 and 0.5 mm.

7. A system as defined in claim 1, wherein said image receiving member is a latent image bearing member.

8. A system as defined in claim 1, further including a toner loading device adjacent to said conveyor to gather toner from a supply thereof and to charge and transfer said toner to said loading segment of said conveyor at a desired rate.

9. A system as defined in claim 8, said toner loading device including corona means to charge said toner for transfer to said conveyor.

10. A system as defined in claim 8, further including a parallel plurality of said toner conveyors, the number of said conveyors being greater than one and less than $(m/a)_i/(m/a)_w$.

11. A system as defined in claim 10, wherein said number is less than six.

12. A system as defined in claim 10, wherein the speed of said traveling wave on said delivery segment is between 1.05 and 1.3 times the speed of said image receiving member.

13. A system for delivering electrostatic toner to an image receiving member, including:

a traveling electrostatic wave toner conveyor including a toner loading segment, and a toner delivery segment;

said delivery segment adapted to receive toner from said loading segment and to present said toner for deposition on said image receiving member;

said delivery segment including a plurality of parallel conveyor electrodes and a plurality of parallel barrier electrodes overlaid on said conveyor electrodes.

said barrier electrodes disposed orthogonally to said conveyor and dielectrically isolated therefrom;

said conveyor electrodes operatively connected to a "multiphase" source of DC-biased multiphase electric power to establish a traveling electrostatic wave in said delivery segment to move toner in a synchronous surfing mode;

said barrier electrodes operatively connected to a "repulsive" source of repulsive DC voltage of the same polarity as said toner to maintain uniformity of toner density delivered to said image receiving member.

14. A system as defined in claim 13, further including an apertured direct printing printhead disposed between said delivery segment and said image receiving member.

15. A system as defined in claim 13, further including nudging electrodes on said delivery segment under the barrier electrodes, said nudging electrodes operatively connected to said "repulsive" source of DC voltage to deflect the path of said toner toward said image receiving member.

16. A system as defined in claim 13, wherein the dielectric thickness separating said barrier electrodes from said conveyor electrodes exceeds ⅛ the wavelength of said traveling wave in said delivery segment.

17. A process of delivering electrostatic toner to an image receiving member, including the following steps:

loading toner onto a segmented traveling electrostatic wave toner conveyor including a toner loading segment and a delivery segment;

applying a DC-biased multiphased voltage to conveyor electrodes on said delivery segment to establish a traveling electrostatic wave in said delivery segment to move said toner in a synchronous surfing mode therealong toward said image receiving member;

applying a repulsive DC voltage, of the same polarity as said toner, to nudging electrodes on said delivery segment to deflect the path of said toner toward said image receiving member.

18. A system as defined in claim 17 wherein said applied voltages establish traveling waves in said delivery segment shorter than in said loading segment, and the transition between said wavelengths on said loading and delivery segments is a stepwise transition over a plurality of waves to maintain said surfing mode of toner motion thereon.

19. A process as defined in claim 17, further including the step of charging said toner by corona currents.

* * * * *